US011867466B2

(12) United States Patent
Zhou et al.

(10) Patent No.: US 11,867,466 B2
(45) Date of Patent: Jan. 9, 2024

(54) COMPACT HEAT EXCHANGER ASSEMBLY FOR A REFRIGERATION SYSTEM

(71) Applicant: Carrier Corporation, Palm Beach Gardens, FL (US)

(72) Inventors: Jianhua Zhou, Manlius, NY (US); Jason D. Scarcella, Cicero, NY (US); Tobias H. Sienel, Baldwinsville, NY (US); Bruce J. Poplawski, Mattydale, NY (US); KeonWoo Lee, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/734,504

(22) PCT Filed: Nov. 4, 2019

(86) PCT No.: PCT/US2019/059639

§ 371 (c)(1),
(2) Date: Dec. 2, 2020

(87) PCT Pub. No.: WO2020/101934

PCT Pub. Date: May 22, 2020

(65) Prior Publication Data

US 2021/0270533 A1 Sep. 2, 2021

Related U.S. Application Data

(60) Provisional application No. 62/758,820, filed on Nov. 12, 2018.

(51) Int. Cl.
*F28D 1/04* (2006.01)
*F25B 39/04* (2006.01)
(Continued)

(52) U.S. Cl.
CPC ..... *F28D 1/0435* (2013.01); *F25B 6/02* (2013.01); *F25B 39/04* (2013.01); *F28D 1/0475* (2013.01);
(Continued)

(58) Field of Classification Search
CPC ..... F25B 6/02; F25B 39/04; F25B 2339/04; F25B 2400/06; F28D 1/0435;
(Continued)

(56) References Cited

U.S. PATENT DOCUMENTS 6,189,335 B1 2/2001 Ebara et al.
6,581,408 B1 6/2003 Tadano et al.
(Continued)

FOREIGN PATENT DOCUMENTS

CN 101806550 A 8/2010
CN 102022851 B 5/2012
(Continued)

OTHER PUBLICATIONS

International Search Report and Written Opinion for International Application PCT/US2019/059639; International Filing Date: Nov. 4, 2019; dated Mar. 31, 2020; 13 pages.
(Continued)

*Primary Examiner* — Eric S Ruppert
*Assistant Examiner* — Hans R Weiland
(74) *Attorney, Agent, or Firm* — CANTOR COLBURN LLP

(57) ABSTRACT

A compact heat exchanger assembly for a refrigeration system includes a heat rejection heat exchanger assembly and a heat absorption heat exchanger assembly. The heat rejection heat exchanger assembly includes a primary heat exchanger and a secondary heat exchanger. The primary heat exchanger has a tube bank extending between a first manifold and a second manifold. The tube bank being provided
(Continued)

with at least one bend such that the primary heat exchanger has a generally curvilinear shape. The secondary heat exchanger is disposed between the first manifold and the second manifold.

19 Claims, 7 Drawing Sheets

(51) Int. Cl.
*F28D 1/047* (2006.01)
*F25B 6/02* (2006.01)
*F28D 21/00* (2006.01)

(52) U.S. Cl.
CPC ..... *F25B 2339/04* (2013.01); *F25B 2400/06* (2013.01); *F28D 2021/007* (2013.01)

(58) Field of Classification Search
CPC .... F28D 1/0433; F28D 1/0452; F28D 1/0475; F28D 2021/007
See application file for complete search history.

(56) References Cited

U.S. PATENT DOCUMENTS

| | | | | |
|---|---|---|---|---|
| 6,622,518 | B2 | 9/2003 | Park | |
| 7,356,998 | B2 | 4/2008 | Lee et al. | |
| 8,327,661 | B2 | 12/2012 | Fujimoto et al. | |
| 8,327,662 | B2 | 12/2012 | Yoshimi et al. | |
| 8,356,490 | B2 | 1/2013 | Yoshimi et al. | |
| 8,356,491 | B2 | 1/2013 | Taras et al. | |
| 8,387,411 | B2 | 3/2013 | Fujimoto et al. | |
| 8,863,545 | B2 | 10/2014 | Fujimoto et al. | |
| 8,966,916 | B2 | 3/2015 | Deaconu | |
| 8,991,207 | B2 | 3/2015 | Takayama et al. | |
| 9,234,685 | B2 | 1/2016 | Koppineedi | |
| 9,746,210 | B2 | 8/2017 | Ko et al. | |
| 9,989,279 | B2 | 6/2018 | Huff et al. | |
| 10,060,687 | B2 * | 8/2018 | Wu | F28D 1/0435 |
| 2003/0066633 | A1 * | 4/2003 | Lee | F28D 1/0435 165/175 |
| 2008/0173434 | A1 * | 7/2008 | Matter | F28F 9/262 165/150 |
| 2008/0256975 | A1 | 10/2008 | Lifson et al. | |
| 2010/0058781 | A1 | 3/2010 | Lifson et al. | |
| 2010/0132917 | A1 * | 6/2010 | Runk | F28D 1/0443 165/67 |
| 2013/0031934 | A1 * | 2/2013 | Huff | F28D 7/10 62/510 |
| 2013/0233524 | A1 | 9/2013 | Taras et al. | |
| 2014/0053585 | A1 | 2/2014 | Huff | |
| 2014/0150489 | A1 | 6/2014 | Gan et al. | |
| 2014/0151015 | A1 | 6/2014 | Sun et al. | |
| 2016/0003545 | A1 * | 1/2016 | Taras | F28D 1/0435 29/890.052 |
| 2017/0010045 | A1 * | 1/2017 | Yang | F28D 1/0443 |
| 2017/0108278 | A1 * | 4/2017 | Yanik | F28D 1/0443 |
| 2017/0146299 | A1 * | 5/2017 | Steinbach | F28D 1/0476 |
| 2017/0205085 | A1 * | 7/2017 | Lu | F28F 1/02 |
| 2018/0135900 | A1 * | 5/2018 | Jindou | F28D 1/0435 |
| 2019/0360754 | A1 * | 11/2019 | Yanik | F28D 1/0435 |
| 2020/0033033 | A1 * | 1/2020 | Yoshioka | F28D 1/0435 |
| 2020/0386453 | A1 * | 12/2020 | Matsumoto | F25B 39/04 |
| 2021/0222893 | A1 * | 7/2021 | Matsui | F28D 1/0435 |

FOREIGN PATENT DOCUMENTS

| | | | |
|---|---|---|---|
| CN | 202928188 | U | 5/2013 |
| CN | 203501743 | U | 3/2014 |
| CN | 102901278 | B | 10/2014 |
| CN | 102901261 | B | 11/2014 |
| CN | 204085299 | U | 1/2015 |
| CN | 103322718 | B | 3/2015 |
| CN | 103344058 | B | 5/2015 |
| CN | 103697627 | B | 12/2015 |
| CN | 107923712 | A | 4/2018 |
| EP | 1571337 | B1 | 2/2005 |
| EP | 2699853 | A1 | 2/2014 |
| EP | 2576885 | B1 | 8/2016 |
| EP | 2251622 | B1 | 8/2018 |
| JP | 2017138085 | A | 8/2017 |
| JP | 2018162934 | A | 10/2018 |
| JP | 2018162938 | A | 10/2018 |

OTHER PUBLICATIONS

Röyttä, P. et al. "Optimissing the refrigeration cucly with a two-stage centrifugal compressor and a flash intercooler", International Journal of Refrigeration, Sep. 2009, vol. 32, Isue 6, pp. 1366-1375, Abstract Only.

Chinese Office Action for Chinese Application No. 201980042642.9; dated Feb. 7, 2023; 6 pages.

* cited by examiner

COMPACT HEAT EXCHANGER ASSEMBLY FOR A REFRIGERATION SYSTEM

CROSS REFERENCE TO RELATED APPLICATIONS

This application is a National Stage application of PCT/US2019/059639, filed Nov. 4, 2019, which claims the benefit of priority to U.S. Provisional Application No. 62/758,820, filed Nov. 12, 2018, both of which are incorporated by reference in their entirety herein.

BACKGROUND

Exemplary embodiments pertain to the art of refrigeration systems.

Refrigeration systems are widely used as part of an air-conditioning system for buildings, cargo systems, storage systems, or the like. The refrigeration systems typically employ various components that are connected by refrigeration lines in a closed circuit. Commonly, refrigeration systems operate with a subcritical refrigeration cycle where the refrigeration system operates below the refrigerant's critical point. Presently there is a push for refrigeration systems to operate with a transcritical refrigeration cycle in which the refrigeration system operates above the refrigerant's critical point.

The operational envelope of the compression device in multi-stage compression systems may be extended by incorporating an additional heat exchanger between two compression stages. Incorporation of the additional heat exchanger into a vapor compression refrigeration system may present challenges due to limitation of space availability, weight and equipment cost considerations.

BRIEF DESCRIPTION

Disclosed is a refrigeration system that includes a compressor assembly, a heat rejection heat exchanger assembly, and a heat absorption heat exchanger assembly. The compressor assembly has an inlet of first compression stage, an outlet of first compression stage, an inlet of second compression stage and an outlet of second compression stage. The heat rejection heat exchanger assembly includes a primary heat exchanger and a secondary heat exchanger. The primary heat exchanger having an inlet that is fluidly connected to the outlet of second compression stage of the compressor assembly and an outlet that is fluidly connected to the inlet of a heat absorption heat exchanger assembly. The primary heat exchanger includes a first tube bank extending between a first manifold and a first intermediate manifold, a second tube bank extending between a second manifold and a second intermediate manifold, at least one bend extending between the first tube bank and the second tube bank, and a connecting tube extending between the first intermediate manifold and the second intermediate manifold. The secondary heat exchanger having a third manifold defining an inlet that is fluidly connected to the outlet of first compression stage of the compressor assembly and a fourth manifold defining an outlet that is fluidly connected to the inlet of second compression stage of the compressor assembly. The heat absorption heat exchanger assembly is fluidly connected to the heat rejection heat exchanger assembly and the compressor assembly.

Also disclosed is a compact heat exchanger assembly that includes a heat rejection heat exchanger assembly includes a primary heat exchanger and a secondary heat exchanger.

The primary heat exchanger has a first tube bank extending from a first manifold, a second tube bank extending from a second manifold, at least one bend arranged to connect the first tube bank and the second tube bank, and bends provided with the first tube bank and the second tube bank such that at least a portion of the first tube bank is disposed parallel to the second tube bank. The secondary heat exchanger is disposed between the second manifold and the at least one bend.

Further disclosed is a compact heat exchanger assembly that includes a heat rejection heat exchanger assembly. The heat rejection heat exchanger assembly includes a primary heat exchanger and a secondary heat exchanger. The primary heat exchanger has a tube bank extending between a first manifold and a second manifold. The tube bank being provided with at least one bend such that the primary heat exchanger has a generally curvilinear shape. The secondary heat exchanger is disposed between the first manifold and the second manifold.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
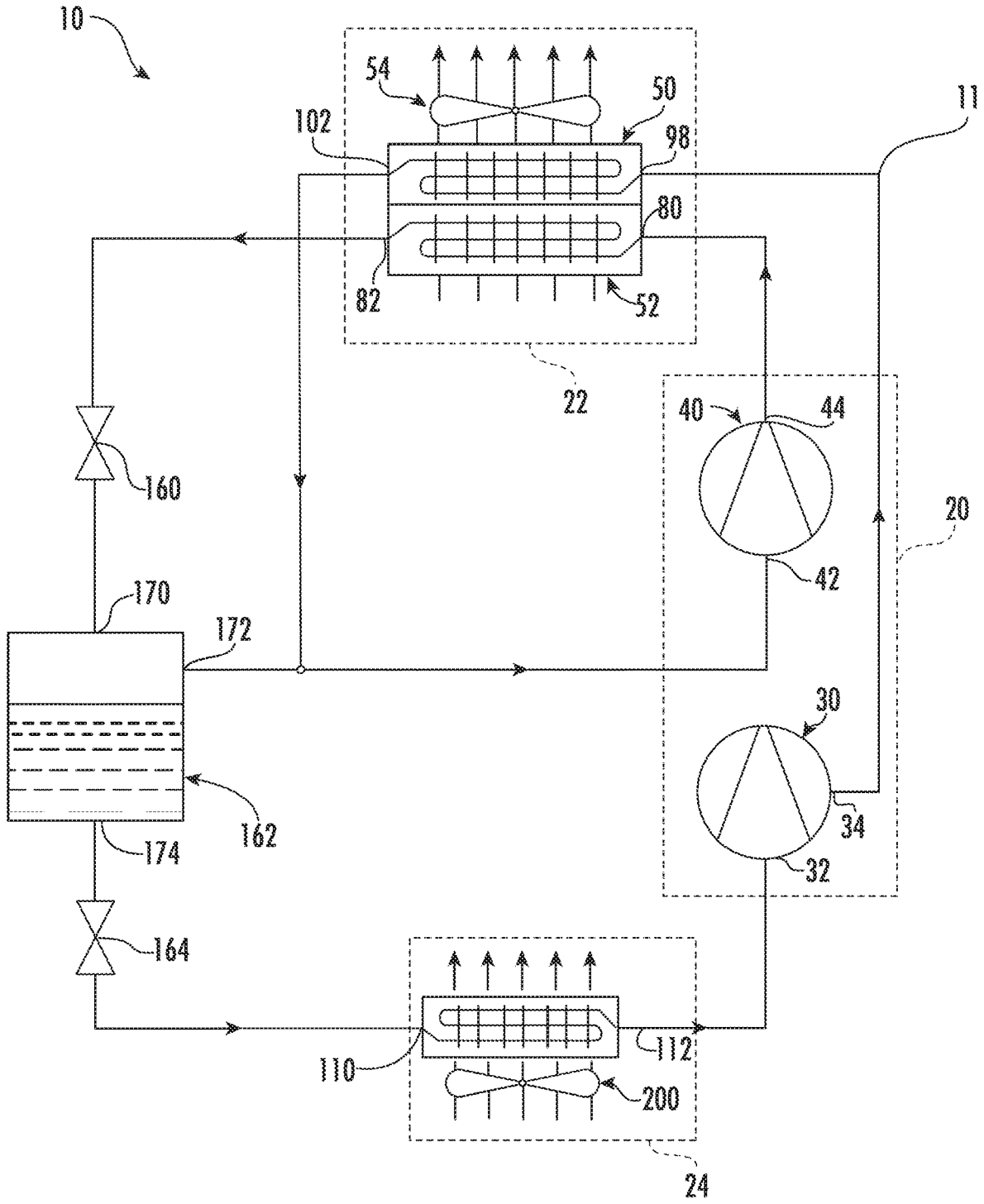
FIG. 1 is a schematic illustration of a refrigeration system.
Figure 2:
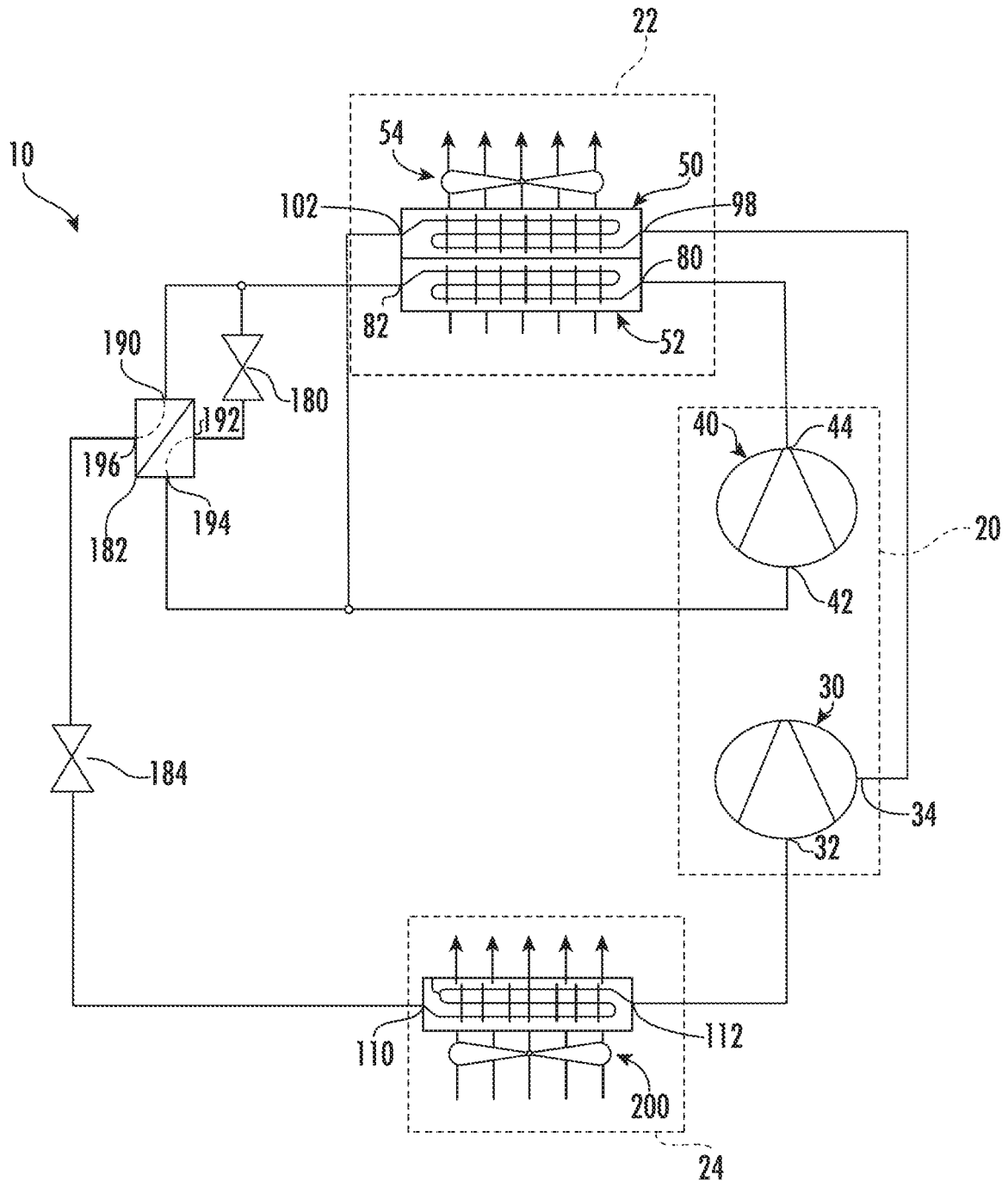
FIG. 2 is a schematic illustration of another refrigeration system.

Referring to FIGS. 1 and 2, a refrigeration system 10 with two stage compression is schematically illustrated. The refrigeration system 10 employs a primary fluid and a secondary fluid. The primary fluid is the working fluid for the refrigeration system, which may be a refrigerant such as carbon dioxide (CO2), and the secondary fluid may be air, water, glycol, or other secondary fluids. The refrigeration system 10 includes a compressor assembly 20, a heat rejection heat exchanger assembly 22 for heat rejection, and a heat absorption heat exchanger assembly 24 for heat absorption.

The compressor assembly 20 is a two-stage compressor assembly provided with a first compressor stage 30 having a inlet of first compression stage 32 and a outlet of first compression stage 34 as well as a second compressor stage 40 having a inlet of second compression stage 42 and a outlet of second compression stage 44. The first compressor stage 30 may be integrally formed with the second compressor stage 40, or the first compressor stage 30 may be provided as a first compressor and the second compressor stage 40 may be provided as a second compressor that is separate from the first compressor.

The inlet of first compression stage 32 is arranged to receive refrigerant from the heat absorption heat exchanger assembly 24 via a port (the heat absorption heat exchanger assembly outlet 112). The refrigerant is compressed by the first compressor stage 30 and the outlet of first compression stage 34 is arranged to discharge the compressed refrigerant to a portion of the heat rejection heat exchanger assembly 22.

The inlet of second compression stage 42 is arranged to receive the refrigerant from the heat rejection heat exchanger assembly 22 and the refrigerant from a flash tank economizer 162 or a heat exchanger type economizer 182, as will be described later. The refrigerant is compressed by the second compressor stage 40 and the outlet of second compression stage 44 is arranged to discharge the compressed refrigerant to another portion of the heat rejection heat exchanger assembly 22.

The heat rejection heat exchanger assembly 22 includes a primary heat exchanger 50, a secondary heat exchanger 52, and a heat rejection fan 54. The primary heat exchanger 50 and the secondary heat exchanger 52 may be arranged as condensers for subcritical refrigeration system or as a gas cooler and intercooler for transcritical refrigeration systems. The primary heat exchanger 50 and the secondary heat exchanger 52 are arranged such that they form a closed shape, a closed duct or closed space having a "U" shape, "V" shape, "O" shape, or other shape within which the heat rejection fan 54 may be disposed, as shown in FIGS. 3-6. The primary heat exchanger 50 and the secondary heat exchanger 52 form a heat rejection heat exchanger assembly 22 in which the two heat exchangers share a common heat rejection fan 54.

Figure 3:
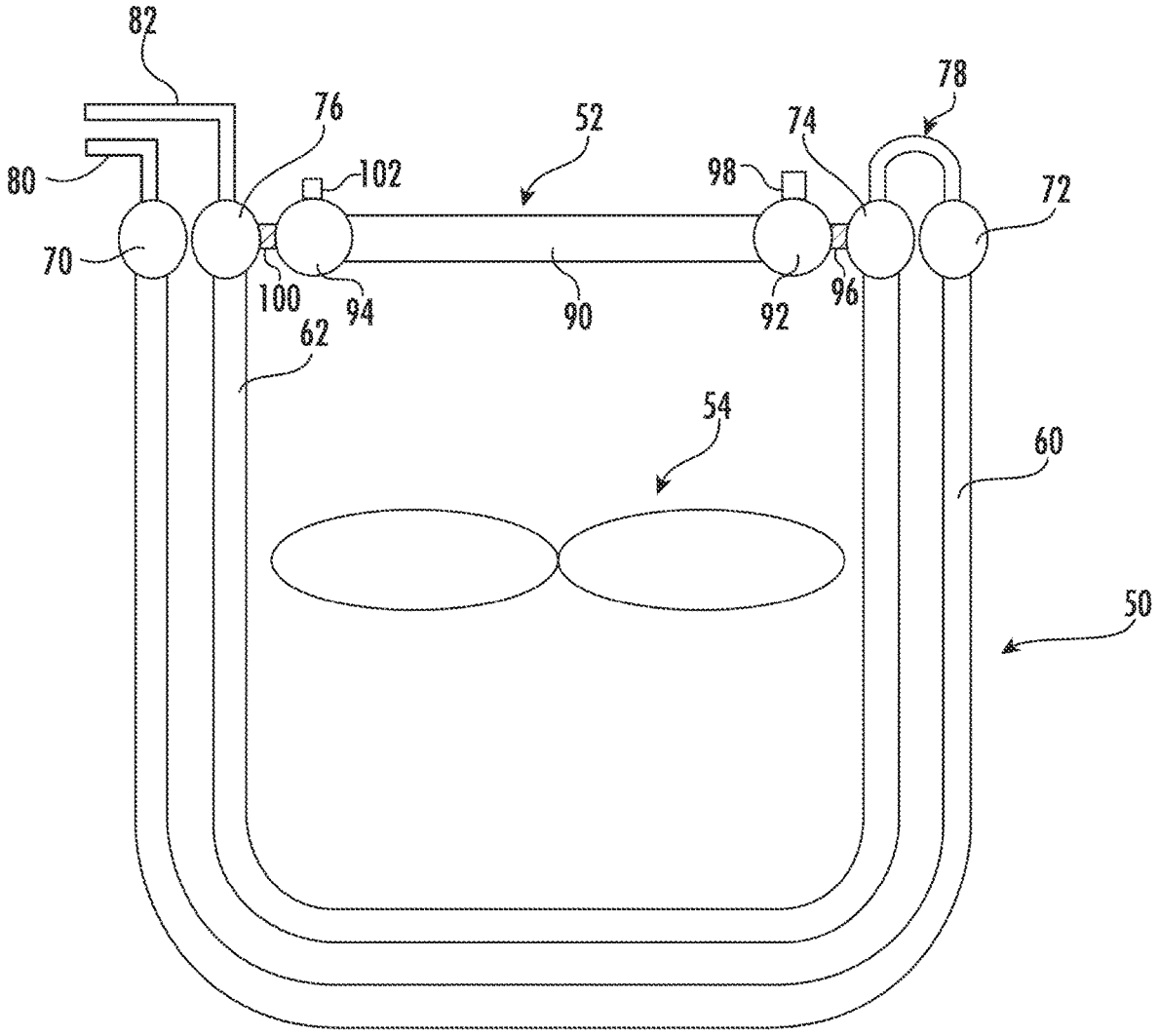
FIG. 3 is a schematic illustration of a first embodiment of a heat exchanger assembly provided with the refrigeration system.

Referring to FIG. 3, the primary heat exchanger 50 includes a first tube bank 60 and a second tube bank 62. The first tube bank 60 is disposed in parallel with the second tube bank 62 such that the primary heat exchanger 50 is arranged as a two row heat exchanger. In each tube bank, fins may be disposed among tubes to enhance heat transfer. The first tube bank 60 extends between a first manifold 70 and a first intermediate manifold 72. The first tube bank 60 may define at least one finned bend between the first manifold 70 and the first intermediate manifold 72 such that the first tube bank 60 has a generally curvilinear shape or a U-shape. The first manifold 70 includes or defines a primary heat exchanger inlet 80 that is fluidly connected to the outlet of second compression stage 44 of the second compressor stage 40 of the compressor assembly 20, as shown in FIGS. 1 and 2.

The second tube bank 62 extends between a second intermediate manifold 74 that is disposed adjacent to the first intermediate manifold 72 and a second manifold 76 that is disposed adjacent to the first manifold 70. The first intermediate manifold 72 is fluidly connected to the second intermediate manifold 74 by a single (or multiple if needed) connecting tube 78. The second tube bank 62 may define at least one finned bend between the second intermediate manifold 74 and the second manifold 76 such that the second tube bank 62 has a generally curvilinear shape or a U-shape. The second manifold 76 includes or defines a primary heat exchanger outlet 82 that is fluidly connected to the inlet 110 of the heat absorption heat exchanger assembly 24 through expansion devices and economizer (e.g. a flash tank type economizer or a heat exchanger type economizer), as shown in FIGS. 1 and 2.

With continued reference to FIG. 3, the secondary heat exchanger 52 is partially disposed within the primary heat exchanger 50. The secondary heat exchanger 52 includes a tube bank section 90 that extends between a third manifold 92 and a fourth manifold 94. The third manifold 92 is disposed adjacent to the second intermediate manifold 74. The spacing between the second intermediate manifold 74 and the third manifold 92 is blocked with some sealing material or a sealing member 96 (e.g. foam, rubber) to avoid air bypassing. The third manifold 92 includes or defines a secondary heat exchanger inlet 98 that is fluidly connected to the outlet of first compression stage 34 of the first compressor stage 30 of the compressor assembly 20, as shown in FIGS. 1 and 2. The fourth manifold 94 is disposed adjacent to the second manifold 76. The spacing between the fourth manifold 94 and the second manifold 76 is blocked with some sealing material or sealing member 96 to avoid air bypassing. The fourth manifold 94 includes or defines a secondary heat exchanger outlet 102 from which the refrigerant, combined with the refrigerant from the flash tank economizer 162 or heat exchanger type economizer 182, enters the inlet of second compression stage 42 of the second compressor stage 40 of the compressor assembly 20, as shown in FIGS. 1 and 2.

The heat rejection fan 54 is disposed within the closed space defined by the tube bank section 90 of the secondary heat exchanger 52 and the first and second tube banks 60 and 62 of the primary heat exchanger 50. The heat rejection fan 54 is arranged to encourage a secondary fluid flow through the primary heat exchanger 50 and the secondary heat exchanger 52 to cool the refrigerant that flows through primary heat exchanger 50 and/or the secondary heat exchanger 52. The sealing members 96, 100 inhibit the leakage of the secondary fluid through the spacing between the primary heat exchanger 50 and secondary heat exchanger 52.

Figure 4:
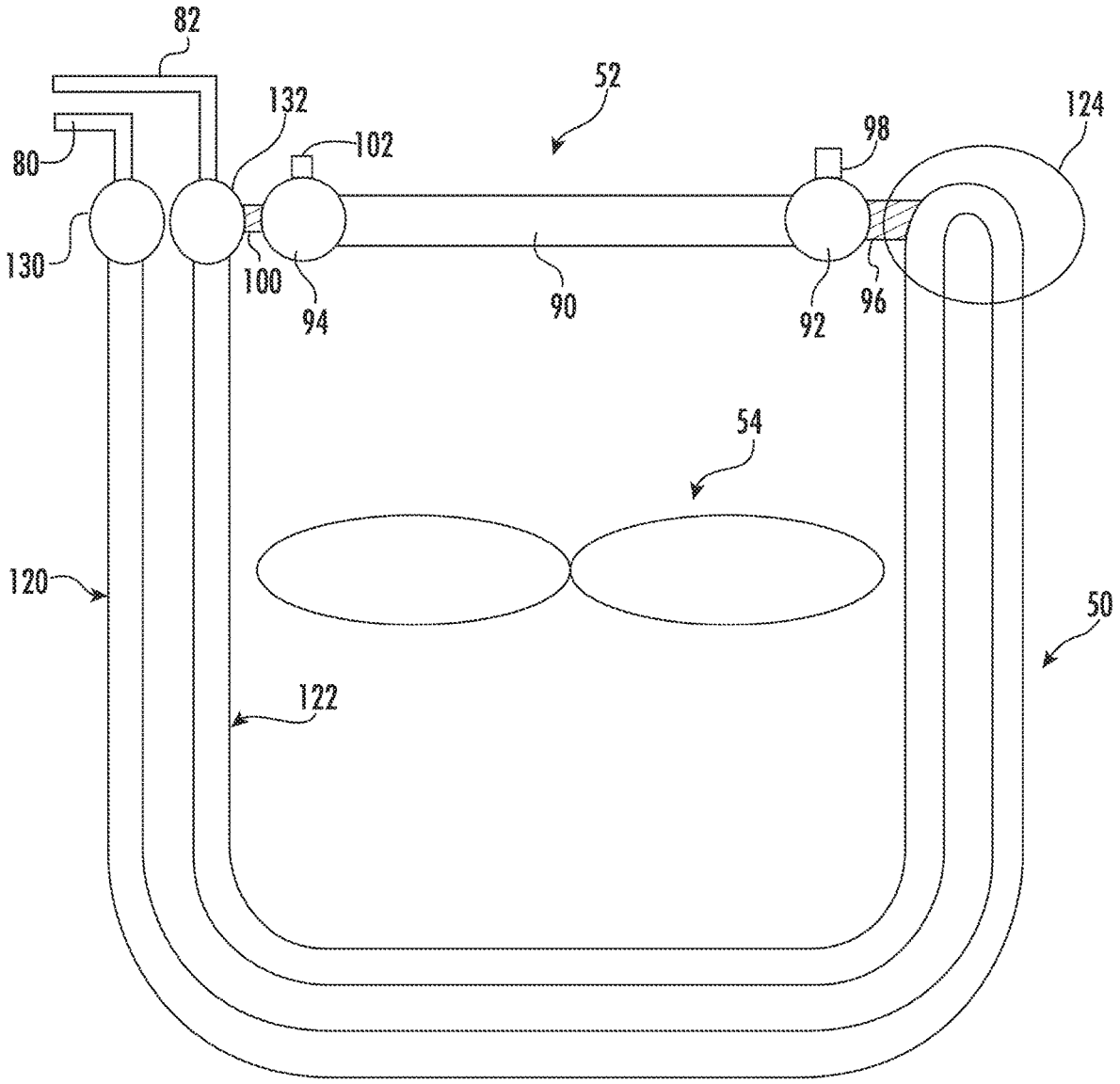
FIG. 4 is a schematic illustration of a second embodiment of a heat exchanger assembly provided with the refrigeration system.

Referring to FIG. 4, the primary heat exchanger 50 may be a continuous tube bank that is folded over on itself such that the tube defines a first tube bank section 120, a second tube bank section 122, and at least one un-finned bend 124. The at least one un-finned bend 124 enables the first tube bank section 120 to be disposed in parallel with the second tube bank section 122 such that the primary heat exchanger 50 is arranged as a two row heat exchanger. The first tube bank section 120 extends between a first manifold 130 and the un-finned bend 124. The first manifold 130 includes or defines the primary heat exchanger inlet 80 that is fluidly connected to the outlet of second compression stage 44 of the second compressor stage 40 of the compressor assembly 20, as shown in FIGS. 1 and 2. The second tube bank section 122 extends between the un-finned bend 124 and a second manifold 132. The second manifold 132 includes or defines a primary heat exchanger outlet 82 that is fluidly connected to the inlet 110 of the heat absorption heat exchanger assembly 24 through expansion devices and economizer, as shown in FIGS. 1 and 2.

The first tube bank section 120 and the second tube bank section 122 may be provided with finned bends, in addition to the un-finned bend 124 such that the combination of the first tube bank section 120 and the second tube bank section 122 has a generally curvilinear shape or a U-shape.

Referring to FIG. 4, the secondary heat exchanger 52 has a substantially similar configuration as the secondary heat exchanger 52 illustrated in FIG. 3. The secondary heat exchanger 52 includes the tube bank section 90 that extends between the third manifold 92 and the fourth manifold 94.

The third manifold 92 is disposed adjacent to the un-finned bend 124, as shown in FIG. 4. The sealing member 96 is used to prevent air leakage through the spacing between the third manifold 92 and the un-finned bend 124. The third manifold 92 includes or defines the secondary heat exchanger inlet 98 that is fluidly connected to the outlet of first compression stage 34 of the first compressor stage 30 of the compressor assembly 20, as shown in FIGS. 1 and 2.

Referring to FIG. 4, the fourth manifold 94 is disposed adjacent to the second manifold 132. The spacing between the fourth manifold 94 and the second manifold 132 is blocked with sealing member 100. The fourth manifold 94 includes or defines the secondary heat exchanger outlet 102 that, combines with the refrigerant from the economizer, is fluidly connected to the inlet of second compression stage of the second compressor stage 40 of the compressor assembly 20, as shown in FIGS. 1 and 2.

Figure 5:
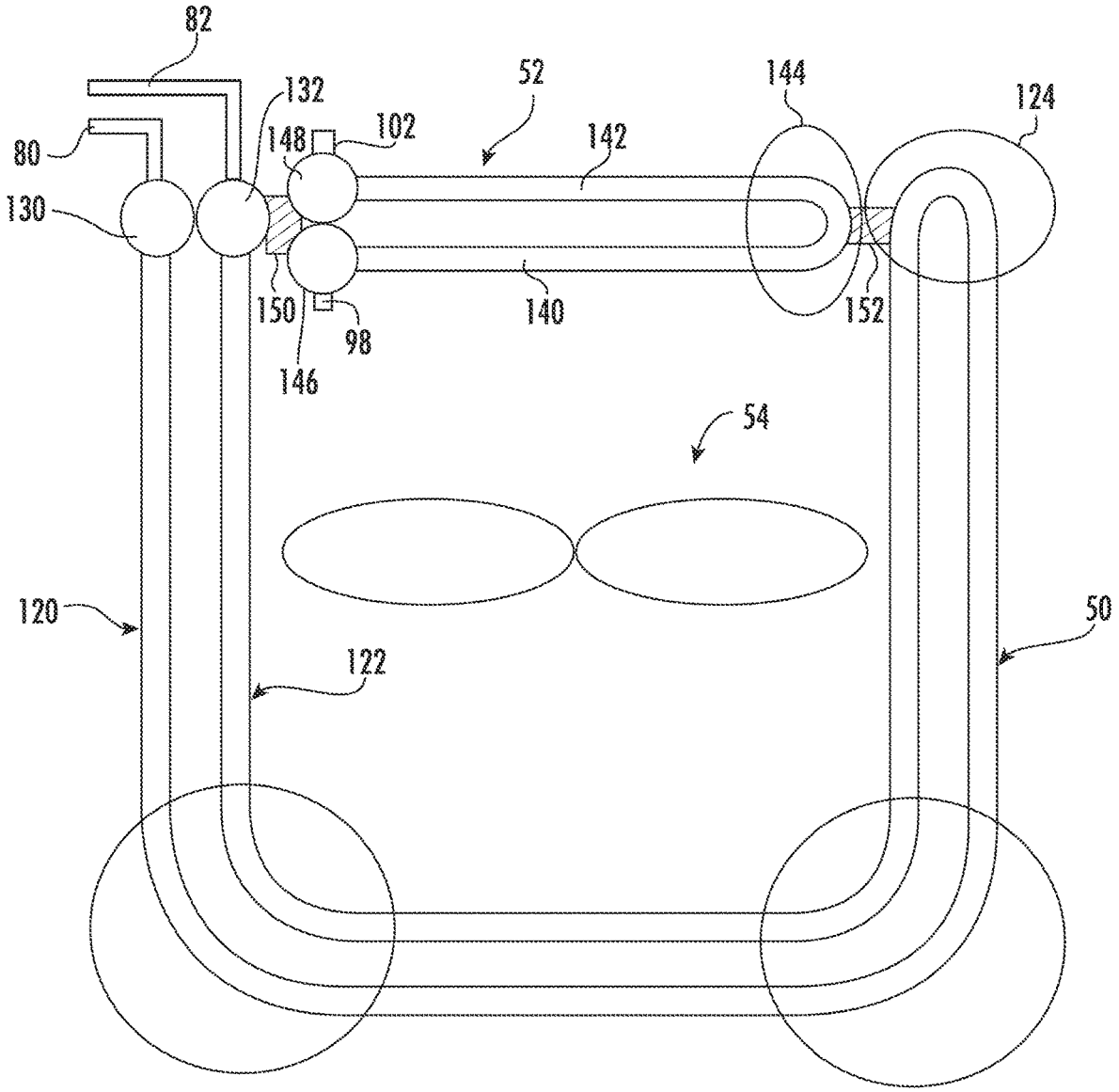
FIG. 5 is a schematic illustration of a third embodiment of a heat exchanger assembly provided with the refrigeration system.

Referring to FIG. 5, the primary heat exchanger 50 may have a substantially similar configuration as illustrated in FIG. 4. However, in this embodiment the secondary heat exchanger 52 includes a continuous tube bank that is folded over on itself such that the tube defines a third tube bank section 140, a fourth tube bank section 142, and at least one un-finned bend 144. The at least one un-finned bend 144 enables the third tube bank section 140 to be disposed in parallel with the fourth tube bank section 142 such that the secondary heat exchanger 52 is arranged as a two row heat exchanger.

The third tube bank section 140 extends between a third manifold 146 and the un-finned bend 144. The third manifold 146 includes or defines the secondary heat exchanger inlet 98 that is fluidly connected to the outlet of first compression stage 34 of the first compressor stage 30 of the compressor assembly 20, as shown in FIGS. 1 and 2. The fourth tube bank section 142 extends between the un-finned bend 144 and a fourth manifold 148. The fourth manifold 148 includes or defines the secondary heat exchanger outlet 102 that, after being combined with the refrigerant from the economizer, is fluidly connected to the inlet of second compression stage 42 of the second compressor stage 40 of the compressor assembly 20, as shown in FIGS. 1 and 2. The spacing between the primary heat exchanger 50 and secondary heat exchanger 52 is blocked with sealing materials 150 and 152.

The heat rejection fan 54 is disposed within the closed "O" shape space defined by the primary heat exchanger 50 and the secondary heat exchanger 52. The heat rejection fan 54 is arranged to encourage the secondary fluid flow through the primary heat exchanger 50 and the secondary heat exchanger 52 to cool the refrigerant. The sealing materials 150, 152 may be sealing members that inhibit the leakage of the secondary fluid through the spacing between the primary heat exchanger 50 and the secondary heat exchanger 52.

Figure 6:
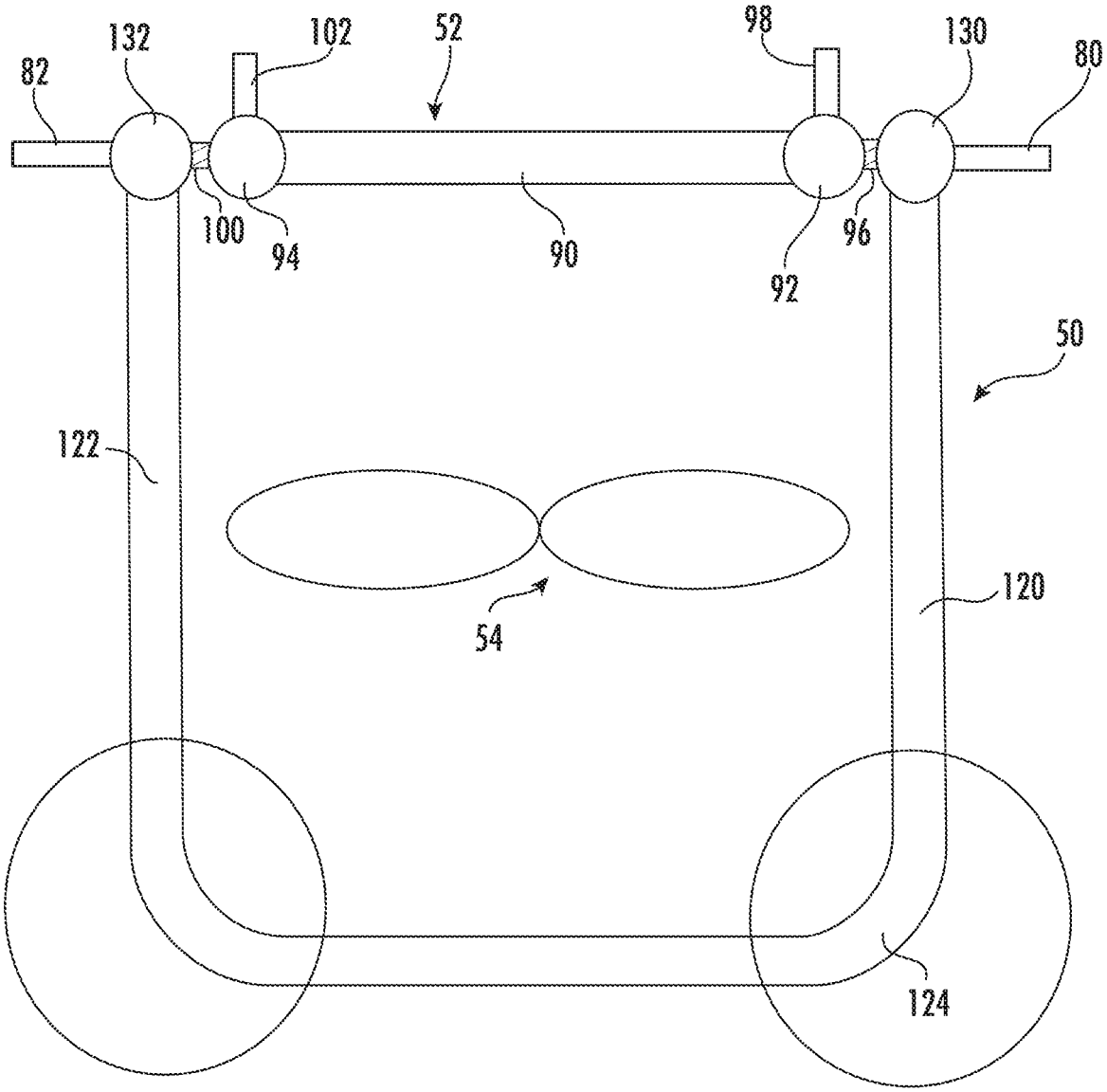
FIG. 6 is a schematic illustration of a fourth embodiment of a heat exchanger assembly provided with the refrigeration system.

Referring to FIG. 6, the primary heat exchanger 50 is a single-row heat exchanger without un-finned bend. The first tube bank section 120 (arranged as a single-row tube bank) extends between a first manifold 130 and a second manifold 132. The first manifold 130 includes or defines the primary heat exchanger inlet 80 that is fluidly connected to the outlet of second compression stage 44 of the second compressor stage 40 of the compressor assembly 20, as shown in FIGS. 1 and 2. The second manifold 132 includes or defines a primary heat exchanger outlet 82 that is fluidly connected to the inlet 110 of the heat absorption heat exchanger assembly 24 through expansion devices and economizer, as shown in FIGS. 1 and 2. The single-row tube bank 120 may be provided with finned bends, such that the primary heat exchanger has a generally curvilinear shape or a U-shape.

The secondary heat exchanger 52 is also a single-row heat exchanger that extends between third manifold 92 and fourth manifold 94. The third manifold 92 includes or defines the secondary heat exchanger inlet 98 that is fluidly connected to the outlet of first compression stage 34 of the first compressor stage 30 of the compressor assembly 20. The fourth manifold 94 includes or defines the secondary heat exchanger outlet 102 that, after being combined with the refrigerant from the economizer, is fluidly connected to the inlet of second compression stage 42 of the second compressor stage 40 of the compressor assembly 20, as shown in FIGS. 1 and 2.

The primary heat exchanger 50 and the secondary heat exchanger 52 form a closed shape configuration. The spacing between the primary heat exchanger 50 and the secondary heat exchanger 52 is blocked with sealing members 96 and 100 to inhibit a flow from bypassing primary heat exchanger 50 and the secondary heat exchanger 52.

The heat rejection fan 54 is disposed within the closed space defined by the primary heat exchanger 50 and the secondary heat exchanger 52. The heat rejection fan 54 is arranged to encourage the secondary fluid flow through the primary heat exchanger 50 and the secondary heat exchanger 52 to cool the refrigerant.

Figure 7:
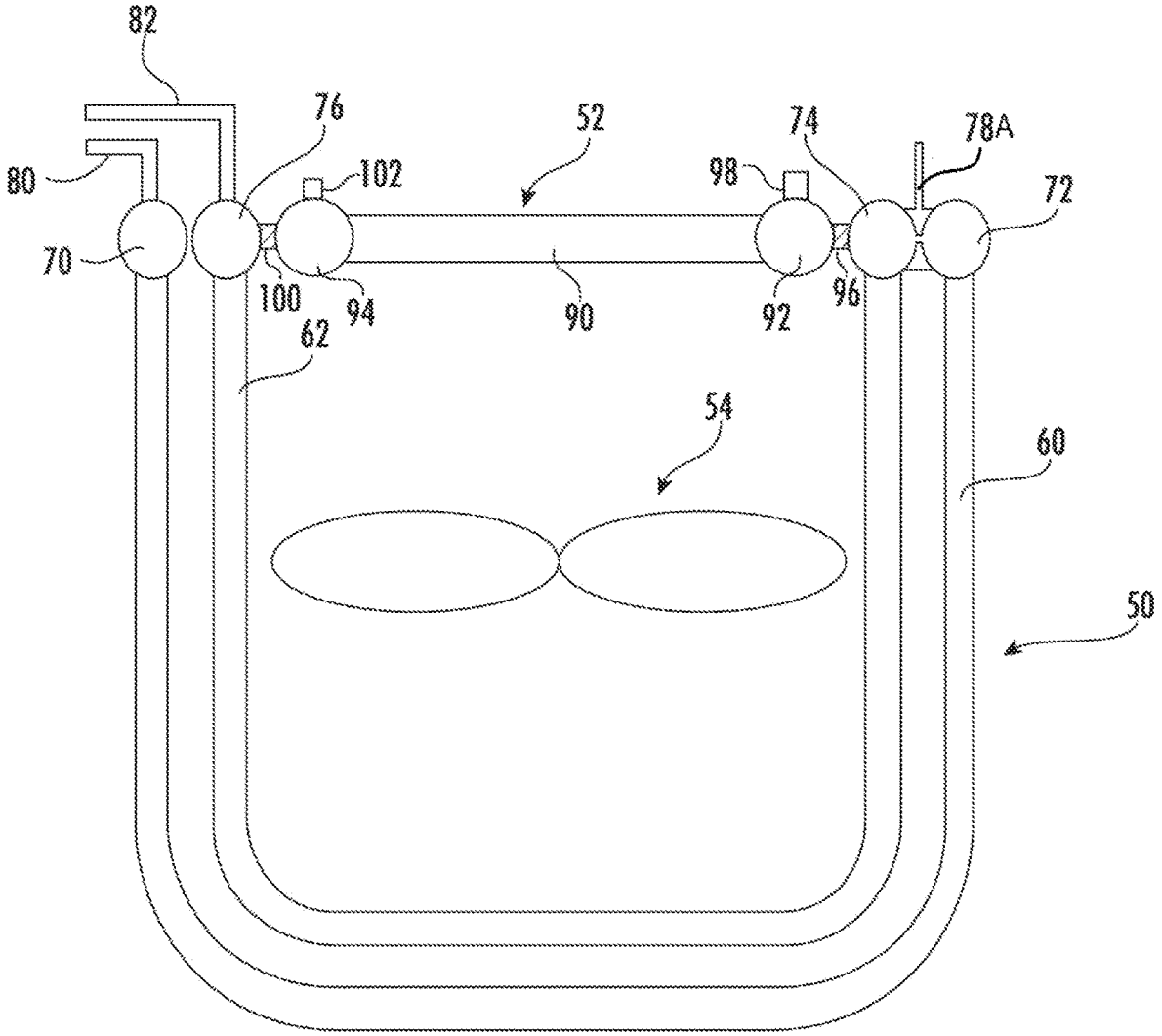
FIG. 7 is a schematic illustration of a fifth embodiment of a heat exchanger assembly provided with the refrigeration system.
Figure 7:
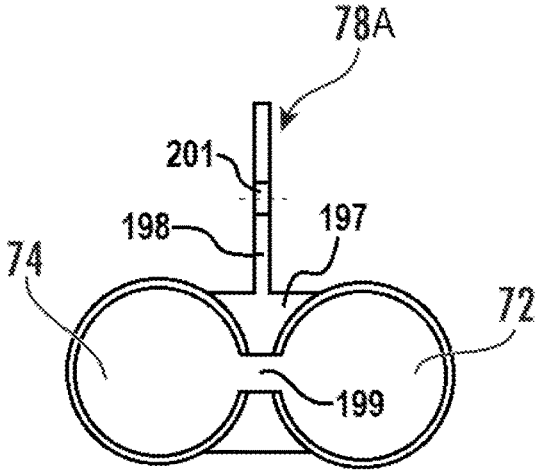

Referring to FIG. 7, the primary heat exchanger 50 and secondary heat exchanger 52 have substantially similar configurations as the primary heat exchanger 50 and secondary heat exchanger 52 illustrated in FIG. 3. The only difference is that the first intermediate manifold 72 is fluidly connected to the second intermediate manifold 74 by a single (or multiple if needed) block part 78A, which is composed of a block 197 with a flow communication hole 199 and a mounting tab 198 with a screw hole 201. The communication hole 199 functions as the refrigerant flow channel so the first intermediate manifold 72 can be fluidly connected to the second intermediate manifold 74. The mounting tab 198 has a screw hole 201, through which the primary heat exchanger 50 can be conveniently mounted to the system architecture. The primary heat exchanger 50 and secondary heat exchanger 52 interact with the rest of the system in a similar way as in FIG. 3.

It may be advantageous to arrange the primary heat exchanger 50 and the secondary heat exchanger 52 of the heat rejection heat exchanger assembly 22 in other configurations to facilitate the mounting of the heat exchanger assembly in the system architecture. For example, the primary heat exchanger 50 shown in FIGS. 3-7 may be arranged upside down such that the inlet and outlet of the heat exchanger as well as the un-finned bend are located at the bottom. In such embodiment, the secondary heat exchanger 52 is also moved to bottom side of the closed shape.

The primary heat exchanger 50 and the secondary heat exchanger 52 of the heat rejection heat exchanger assembly 22 and the heat absorption heat exchanger assembly 24 may be mini-channel flat-tube louvered-fin heat exchangers, round-tube plate-fin heat exchangers, or any other types of heat exchangers to facilitate heat exchange between the primary fluid and the secondary fluid.

Referring to FIGS. 1 and 2, the heat absorption heat exchanger assembly 24 includes the heat absorption heat exchanger assembly inlet 110 and the heat absorption heat exchanger assembly outlet 112.

The heat absorption heat exchanger assembly inlet 110 is fluidly connected to the primary heat exchanger outlet 82 of the primary heat exchanger 50 through a first expansion device 160, a flash tank economizer 162, and a second expansion device 164, as shown in FIG. 1. The flash tank economizer 162 may be provided with a inlet of first compression stage 170, a outlet of first compression stage 172, and a outlet of second compression stage 174. The inlet of first compression stage 170 is arranged to receive refrigerant from the primary heat exchanger outlet 82 through the first expansion device 160. The outlet of first compression stage 172 of the flash tank economizer 162 is arranged to provide refrigerant, in vapor form, to the inlet of second compression stage 42 of the second compressor stage 40 of the compressor assembly 20. The outlet of second compression stage 174 is arranged to provide refrigerant, in a liquid form, to the second expansion device 164 that ultimately provides refrigerant to the heat absorption heat exchanger assembly inlet 110.

As an alternative design, the heat absorption heat exchanger assembly inlet 110 is fluidly connected to the primary heat exchanger outlet 82 of the primary heat exchanger 50 through a heat exchanger type economizer 182 and a second expansion device 184, as shown in FIG. 2. The heat exchanger type economizer 182 may be provided with a first inlet 190, a second inlet 192, a first outlet 196, and a second outlet 194. The refrigerant coming from the primary heat exchanger outlet 82 of the primary heat exchanger 50 is divided into two streams. One stream enters the first inlet 190 and another stream enters the inlet 192 through the first expansion device 180. The two streams exchange heat in the heat exchanger type economizer 182. The refrigerant stream entering the first inlet 190 is cooled down and is then connected to the secondary heat exchanger assembly inlet 110 of the heat absorption heat exchanger assembly 24 through the second expansion device 184. The refrigerant stream entering the inlet of second compression stage 192 is heated up and is then combined with the refrigerant coming from the secondary heat exchanger outlet 102 of the secondary heat exchanger 52 of the heat rejection heat exchanger assembly 22, connected to the inlet of second compression stage 42 of the second compressor stage 40 of the compressor assembly 20.

The heat absorption heat exchanger assembly outlet 112 is fluidly connected to the inlet of first compression stage 32 of the first compressor stage 30 of the compressor assembly 20.

A heat absorption fan 200 is provided with the heat absorption heat exchanger assembly 24. The heat absorption fan 200 is arranged to draw a second fluid through the heat absorption heat exchanger assembly 24 to heat the refrigerant that passes through the heat absorption heat exchanger assembly 24.

The heat rejection heat exchanger assembly 22 employing the secondary heat exchanger 52 being at least partially disposed within the primary heat exchanger 50 to form a closed shape that provides a compact, lightweight, and lower cost heat exchanger with high heat transfer efficiency as well as an adaptable architecture to facilitate integration with various refrigeration systems. The compactness of the heat rejection heat exchanger assembly 22 is achieved by arranging the primary and secondary heat exchangers in a closed shape sharing a common heat rejection fan having a different radius, meaning the different heat exchanger sizes can be orientated in any angles, which is advantageous over traditional flat heat exchangers which usually take up a much larger space.

The heat exchangers of the present disclosure may employ aluminum or aluminum alloys having better ductility and formability as compared to traditional copper heat exchangers. Furthermore, the all-aluminum heat exchangers are generally lighter and cheaper than copper tube heat exchangers.

The primary heat exchanger 50 and the secondary heat exchanger 52 of the heat rejection heat exchanger assembly 22 may be arranged in cross-counter flow with respect to the secondary fluid flow. This cross-counter flow configuration provides very good heat transfer efficiency.

Although the exemplary embodiments involve single-row or two-row heat exchangers only, multiple-row heat exchangers or any combinations of primary heat exchanger 50 and secondary heat exchanger 52 with different rows or with different bend scenarios may also fall in the scope of the present disclosure.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A refrigeration system, comprising:

a compressor assembly having an inlet of first compression stage, an outlet of first compression stage, an inlet of second compression stage, and an outlet of second compression stage;

a heat rejection heat exchanger assembly, comprising:

a primary heat exchanger having an inlet that is fluidly connected to the outlet of second compression stage of the compressor assembly and an outlet that is fluidly connected to the inlet of a heat absorption heat exchanger assembly, the primary heat exchanger, comprising:

a first tube bank extending between a first manifold and a first intermediate manifold, a second tube bank extending between a second manifold and a second intermediate manifold, at least one bend extending between the first tube bank and the second tube bank and fluidly connecting the first tube bank to the second tube bank, and a connecting tube or a block part extending between the first intermediate manifold and the second intermediate manifold;

a secondary heat exchanger having a third manifold defining an inlet that is fluidly connected to the outlet of first compression stage of the compressor assembly and a fourth manifold defining an outlet that is fluidly connected to the inlet of second compression stage of the compressor assembly; and the heat absorption heat exchanger assembly fluidly connected to the heat rejection heat exchanger assembly and the compressor assembly;

wherein the primary heat exchanger and the secondary heat exchanger are arranged in a closed shape;

wherein a sealing member connects the third manifold and the second intermediate manifold to seal between the primary heat exchanger and the secondary heat exchanger;

wherein the primary heat exchanger is U-shaped and the secondary heat exchanger extends across a width of the U-shape to define the closed shape.

2. The refrigeration system of claim 1, the secondary heat exchanger is arranged as a single-row heat exchanger.

3. The refrigeration system of claim 1, the at least one bend being a finned bend.

4. The refrigeration system of claim 1, the primary heat exchanger is arranged as a two-row heat exchanger.

5. The refrigeration system of claim 1, the heat absorption heat exchanger assembly having an outlet that is fluidly connected to the inlet of first compression stage of the compressor assembly and an inlet that is fluidly connected to the outlet of the primary heat exchanger of the heat rejection heat exchanger assembly through expansion devices and an economizer.

6. The refrigeration system of claim 5, the economizer is at least one of a flash tank type economizer or a heat exchanger type economizer.

7. The refrigeration system of claim 1, the third manifold is disposed adjacent to the second intermediate manifold and the fourth manifold is disposed adjacent to the first intermediate manifold.

8. The refrigeration system of claim 7, further comprising:

a heat rejection fan disposed within the closed shape defined by the primary heat exchanger and the secondary heat exchanger.

9. A compact heat exchanger assembly, comprising:

a heat rejection heat exchanger assembly, comprising:

a primary heat exchanger, comprising:

a first tube bank extending from a first manifold, a second tube bank extending from a second manifold, at least one bend arranged to fluidly connect the first tube bank to the second tube bank, and bends provided with the first tube bank and the second tube bank such that at least a portion of the first tube bank is disposed parallel to the second tube bank; and a secondary heat exchanger disposed between the second manifold and the at least one bend;

wherein the primary heat exchanger and the secondary heat exchanger are arranged in a closed shape;

wherein a sealing member connects the secondary heat exchanger to the second manifold to seal between the primary heat exchanger and the secondary heat exchanger;

wherein the primary heat exchanger is U-shaped and the secondary heat exchanger extends across a width of the U-shape to define the closed shape.

10. The compact heat exchanger assembly of claim 9, the at least one bend being an un-finned bend.

11. The compact heat exchanger assembly of claim 9, the bends being finned bends.

12. The compact heat exchanger assembly of claim 9, further comprising fins interposed between neighboring tubes of the first tube bank and the second tube bank.

13. The compact heat exchanger assembly of claim 9, the secondary heat exchanger includes:

a tube bank section that extends between a third manifold and an un-finned bend.

14. The compact heat exchanger assembly of claim 9, wherein the secondary heat exchanger of the heat rejection heat exchanger assembly is arranged as a single-row heat exchanger.

15. A compact heat exchanger assembly, comprising:

a heat rejection heat exchanger assembly, comprising:

a primary heat exchanger, comprising:

a first tube bank extending from a first manifold, a second tube bank extending from a second manifold, at least one bend arranged to fluidly connect the first tube bank to the second tube bank;

the first tube ban and the second tube bank being provided with at least one bend such that the primary heat exchanger has a generally curvilinear shape; and a secondary heat exchanger disposed between the first manifold and the second manifold;

wherein the primary heat exchanger and the secondary heat exchanger are arranged in a closed shape;

wherein a sealing member connects the secondary heat exchanger to the second manifold to seal between the primary heat exchanger and the secondary heat exchanger;

wherein the primary heat exchanger is U-shaped and the secondary heat exchanger extends across a width of the U-shape to define the closed shape.

16. The compact heat exchanger assembly of claim 15, the at least one bend being a finned bend.

17. The compact heat exchanger assembly of claim 15, the secondary heat exchanger includes:

a tube bank section that extends between a third manifold and a fourth manifold.

18. The compact heat exchanger assembly of claim 17, the first manifold is disposed adjacent to the third manifold and the second manifold is disposed adjacent to the fourth manifold.

19. The compact heat exchanger assembly of claim 17, the primary heat exchanger and the secondary heat exchanger of the heat rejection heat exchanger assembly are each arranged as single-row heat exchangers.

* * * * *